United States Patent [19]

Bailey

[11] Patent Number: 4,979,590

[45] Date of Patent: Dec. 25, 1990

[54] LADDER PLATFORM

[75] Inventor: William Bailey, Daisy Hill, Australia

[73] Assignee: Bailey Aluminum Products Pty. Ltd., Queensland, Australia

[21] Appl. No.: 452,216

[22] Filed: Dec. 18, 1989

[30] Foreign Application Priority Data

Jan. 11, 1989 [AU] Australia ..... PJ2226

[51] Int. Cl.[5] ..... E06C 7/14; E06C 7/48

[52] U.S. Cl. ..... 182/106; 182/129; 248/238

[58] Field of Search ..... 248/238, 210, 211; 182/106, 129, 116

[56] References Cited

U.S. PATENT DOCUMENTS

| | | | |
|---|---|---|---|
| 3,182,749 | 5/1965 | Girardello | 248/238 |
| 4,205,411 | 6/1980 | Cupp | 248/210 |
| 4,480,810 | 11/1984 | Hall | 248/238 |
| 4,515,242 | 5/1985 | La Chance | 182/106 |
| 4,653,713 | 3/1987 | Hamilton | 248/238 |
| 4,706,918 | 11/1987 | Wilson | 248/210 |
| 4,874,147 | 10/1989 | Ory . | |

*Primary Examiner*—Reinaldo P. Machado

*Attorney, Agent, or Firm*—Helfgott & Karas

[57] ABSTRACT

A ladder platform for step ladder, ladder or extension ladder. The platform has two tray positions which hinge relative to one another and are movable between a storage position and a work position. One tray portion has integral handles and is securable to stiles of the ladder. The platform, in the work position, can support tools or other items.

20 Claims, 4 Drawing Sheets

Fig.1.
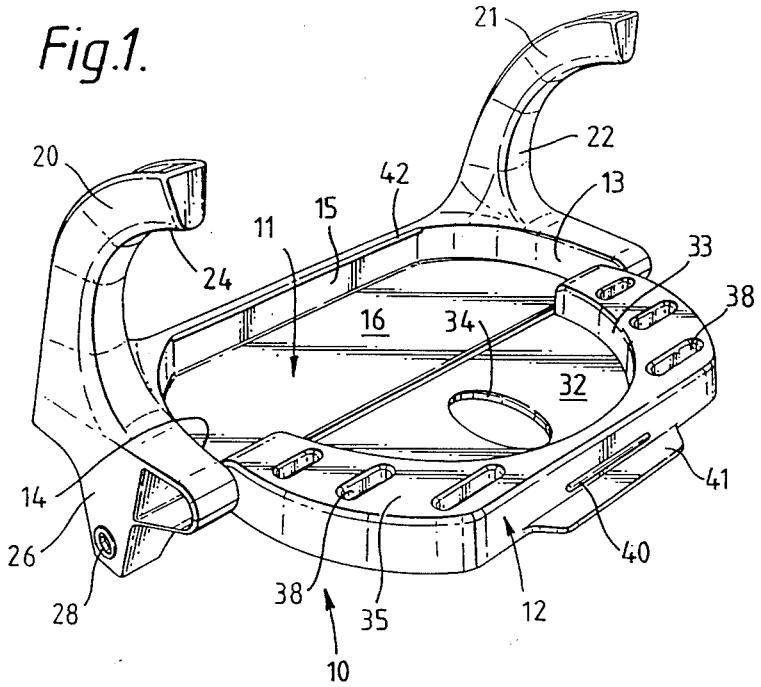
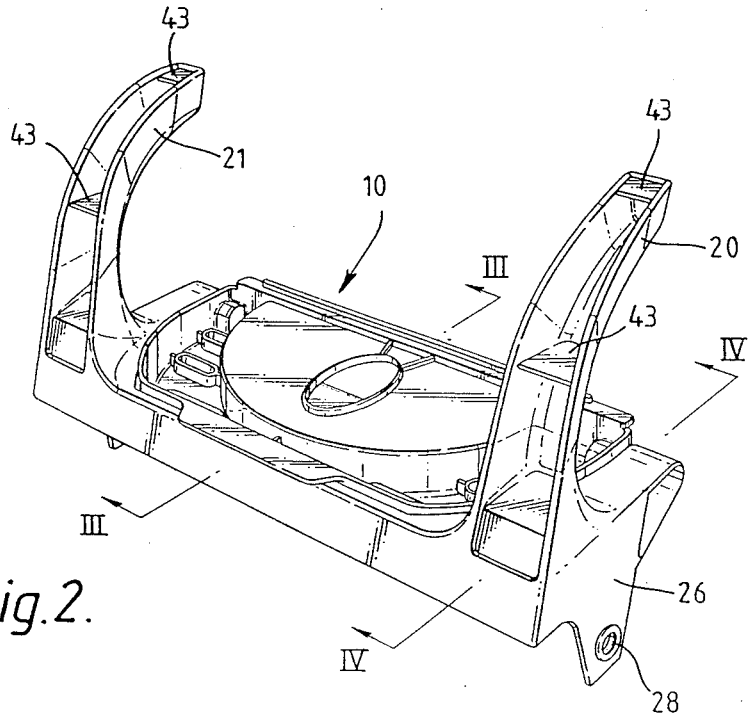
Fig.2.

Fig.3.
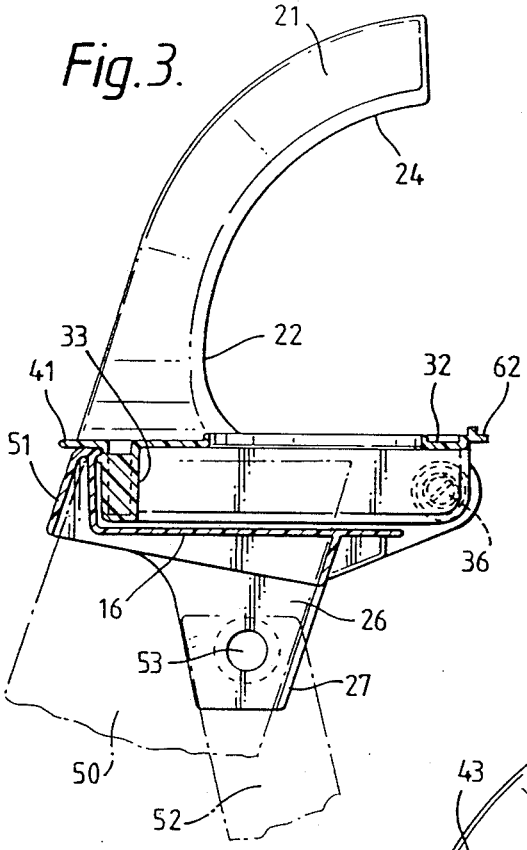
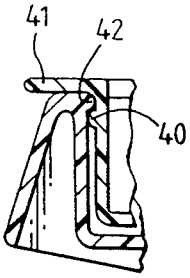
Fig.5.
Fig.6.
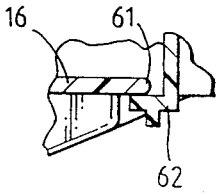
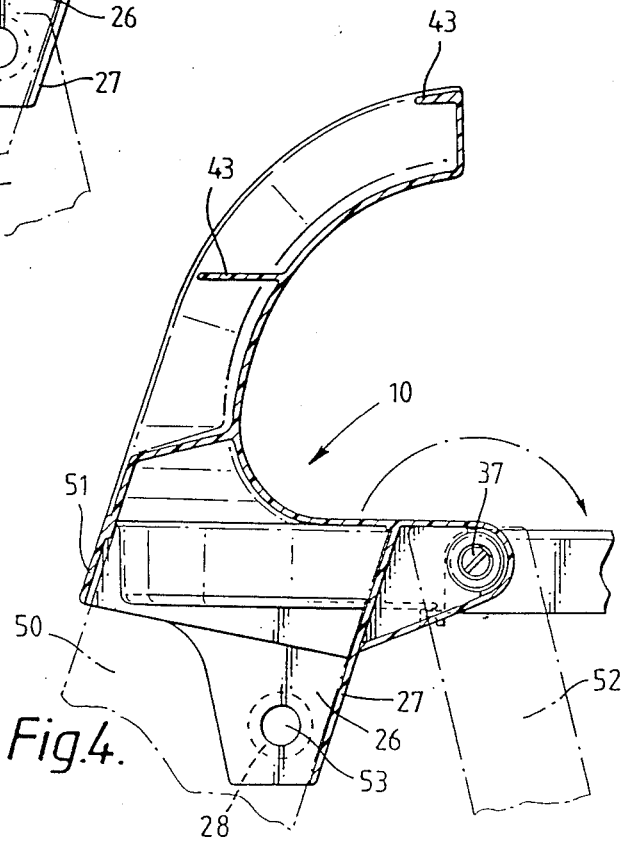
Fig.4.

LADDER PLATFORM

TECHNICAL FIELD OF THE INVENTION

The invention relates to ladders and stepladders. In particular, the invention relates to an improved uppermost step or platform for a ladder or stepladder.

BACKGROUND OF THE INVENTION

Attachments for ladders and stepladders have been proposed. These attachments typically are provided as components separate from the ladder and securable (usually detachable) to either a stile or step of the ladder.

U.S. Pat. Nos. 3104859 and 3108776 disclose attachments mountable relative to a step of a ladder. The attachment of U.S. Pat. No. 3104859 is adapted to carry a paint bucket or can and is releasably received over the step. The attachment of U.S. Pat. No. 3108776 is also adapted to receive a paint can but in this case the attachment is releasably secured to the step.

U.S. Pat. Nos. 3052442 and 3131900 disclose attachments mountable relative to a stile of a ladder. In U.S. Pat. No. 3052442 the attachment is releasably received by the stile whilst in U.S. Pat. No. 3131900 the attachment is releasably secured to the stile.

All of these earlier proposals were only suitable for holding paint cans and because they were components separate from the ladder itself they needed to be removed either for proper operation of the ladder where that ladder was an extension ladder or needed to be removed when the ladder was collapsed for storage.

Other earlier proposals suggested the use of a removable shelf on a ladder with the shelf able to be mounted at a desired step on the ladder. U.S. Pat. No. 2166255 discloses such a proposal. This shelf was not an integral part of the ladder and would have to be removed when the ladder was collapsed. In addition, because the shelf needed to be placed on a step intermediate the first step and the seat or platform on the ladder, the versatility of the ladder was restricted.

U.S. Pat. No. 2109886 disclosed a ladder having an integral platform at the top thereof movable between a storage position and an operative position in which it was held by pins. The platform was adapted to hold tools and in addition a paint can could be stood on the platform. In this proposal it was necessary to move the platform between its two positions and if a platform was not required and it was left in its storage position during use of the ladder—the ladder did not have a useful step or platform at its upper end. If a step was required the platform needed to be moved to its operative position in which is projected a substantial distance laterally of the ladder and this was undesirable.

U.S. Pat. No. 2643808 was provided with an uppermost step or platform having two sections pivotally secured to one another. The sections could be moved between an overlapping configuration to provide a narrow platform and a configuration where the sections were side by side to provide a wide platform. This platform, whilst an improvement on that disclosed in U.S. Pat. No. 2109886, was not versatile in its use for receiving tools or a paint can. In addition, the platform in its position on the same side of the stepladder as the steps made that ladder difficult to use. The platform projected laterally over the ladder and made lower steps difficult to negotiate. This platform could not readily be employed with ladders other than stepladders.

SUMMARY OF THE INVENTION

It is an object of the invention to provide a platform for a ladder which at least minimises the disadvantages referred to above.

Accordingly, the invention provides a platform for a ladder or stepladder including a first tray portion, a second tray portion pivotally coupled to said first tray portion and movable from a storage position where said tray portions overly each other to a work position where the second tray portion forms an extension to the first tray portion to provide a tray.

The first tray portion preferably has a base. The base may be substantially rectangular in shape although it may have other shapes. Preferably the base is planar although it may be formed with apertures relative to which tools or the like may locate. Preferably the base has one or more locating depressions relative to which paint buckets or cans may be located. The depressions are preferably circular in shape. Preferably a plurality of concentric circular depressions are formed in the base—each depression corresponding in size to a respectively sized paint can.

The base may have an upstanding peripheral wall extending outwardly of and at least part way around the base. Where the base is rectangular it is preferred that the peripheral wall extend around three sides of the rectangle.

The first tray portion may be formed with integral handles. Where handles are present it is preferred that there be two spaced handles extending from the tray portion at locations adjacent where stiles of a ladder would normally locate relative to the platform. The handles may have a contoured profile corresponding to a hand grip of a user. Preferably the handles are at opposed edges of the first tray portion. The handles may have an L shaped configuration having the hand grip profile on a portion extending outwardly of the first tray portion and a portion extending substantially parallel to and spaced from the base of the first tray portion. The hand grip portion preferably extends at about 72 degrees to the base.

The platform may have attachment portions enabling the platform to be secured to the stiles of a ladder or stepladder. The attachment portions may comprise attachment flanges or webs. Preferably, the attachment portions each consist of two flanges arranged substantially at right angles to one another. The two flanges extend downwardly from the first tray portion and at spaced locations thereof. Preferably one of the flanges of each pair of attachment flanges forms a planar extension to the peripheral wall of the first tray portion. The stiles may be fixed to the pairs of attachment flanges by fasteners.

The second tray portion, as mentioned above, is pivotally coupled to the first tray portion. One or more pivot members or pins may be used for this purpose. Preferably two pivot pins are used. The pivot pins may be formed integral with either of the tray portions or provided as separate components.

The second tray portion of the platform may have a base. The base may be any suitable shape. Preferably, this base is of a size and shape corresponding to the base of the first tray portion. Preferably this base is rectangular. Whilst this base may be planar it need not be. The second tray portion may have a peripheral upstanding wall extending at least partway around the base. Preferably, the peripheral wall extends outwardly from three sides of the base. It is preferred that the wall on the base of the second tray portion be of a height similar or the same as the height of the wall on the other base.

The second tray portion may be provided with one or more partitions. Preferably one partition only is present. The one partition together with adjacent parts of the peripheral wall together define a walled receptacle for tools. That part of the base which defines the bottom of the receptacle may have one or more apertures through which tools may project and relative to which tools may locate.

BRIEF DESCRIPTION OF THE DRAWINGS

A particular preferred embodiment of the invention will now be described by way of example with reference to the drawings in which:

FIG. 1 is a perspective view of a ladder platform according to an embodiment of the invention shown in the work position;

FIG. 2 is a perspective view of the platform of FIG. 1 shown in a storage position;

FIG. 3 is a sectional view along line III—III of FIG. 2;

FIG. 4 is a sectional view along line IV—IV of FIG. 2;

FIG. 5 is an enlarged fragmentary sectional view of the platform when in the storage position;

FIG. 6 is an enlarged fragmentary sectional view of the platform when in the work position;

DETAILED DESCRIPTION

Figure 7:
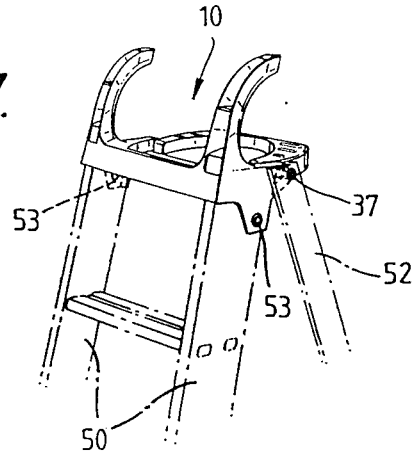
FIG. 7 is a perspective view showing one way of attaching the platform to a step ladder.

In FIG. 1 the platform !0 is shown in the work position. The platform has a first tray portion 11, opposed side walls 13, 14 (only one of which is readily visible) and an end wall 15. These walls extend upwardly from base 16 and around three edges thereof.

Handles 20, 21 are integrally formed with portion 11 and walls 13, 14 and 15 merge into the handles. Each handle has a grip portion 22 which extends outwardly from the base 11 and a portion 24 which extends substantially parallel to and spaced from base 16.

Attachment flanges 26, 27 (see FIGS. 3 and 4) extend downwardly from the base 16 and between them may receive a stile to enable the platform 10 to be mounted to an upper end thereof. Both flanges 26 have an aperture 28 to enable mounting of the platform relative to stiles of a ladder.

Second tray portion 12 has a base 32 and an arcuate wall 33 extending around the base 32. Portion 12 is pivotally connected to portion 11 by pivot pins 36, 37. The base 32 has an aperture 34 relative to which tools may locate. Ledge 35 is provided with further tool receiving apertures 38.

FIG. 1 shows that the tray portion 12 has a locking bead 40 adjacent to a ledge 41. Bead 40 engages over bead 42 formed in wall 15 to enable the tray portions to be yieldably locked in the position shown in FIG. 2. The way in which the beads 40. 42 engage is shown in FIG. 5. To unlock the beads, ledge 41 is grasped by a user and portion 12 is pivoted relative to portion 11 to cause bead 40 to ride over bead 42.

In FIG. 2 the platform 10 is shown in the storage position. The handles 20, 21 have strengthening webs 43 formed in them.

In FIG. 4 the platform 10 is shown in its storage position and a ladder stile 50 is shown in broken outline. The stile 50 is received within the platform and has its free end substantially boxed in by flanges 26, 27 and face 51 of tray portion 11. FIG. 4 shows one way in which the platform can be attached to a step ladder with the rear legs 52 (only one of which is shown) pivotally secured to stiles 50 by the connectors 53 received in apertures 28. Thus, the connectors which attach the platform 10 to the stiles 50 also secure the rear legs of the step ladder to the stiles.

FIGS. 4 and 7 show an alternative fixing arrangement. In these figures the platform 10 is secured to stiles 50 by connectors 53 while rear legs 52 ar pivotally coupled to the platform 10 by pivot pins 36, 37.

Figure 8:
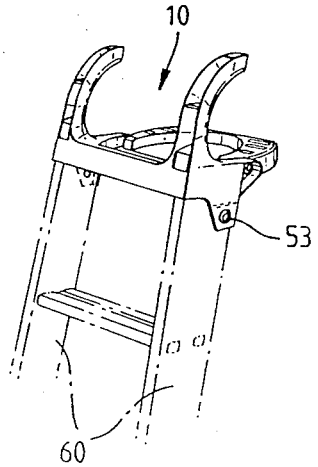
FIG. 8 is a perspective view showing one way of attaching the platform to a ladder.

FIG. 8 shows a platform 10 connected to stiles 60 of a ladder by connectors 53 (only one of which is visible).

The handles 20, 21 assist in the user of the ladder in climbing the ladder and ensure that the user does not need to grasp the ladder stiles as he ascends or descends. This is advantageous since sometimes the stiles may have sharp edges or become damaged during use. Such edges or damage can cause skin lacerations or cuts. The handles also present an aid to assist balancing during ascent and descent.

Figure 9:
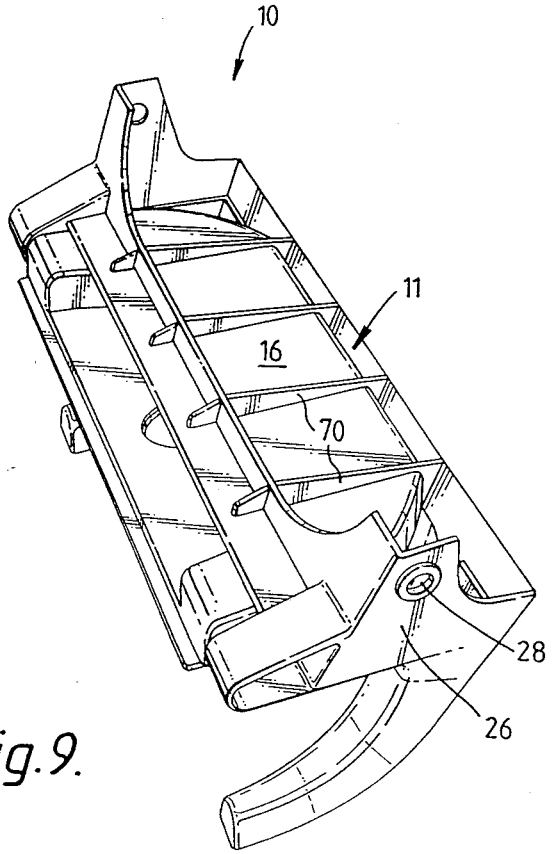
FIG. 9 is an inverted perspective view of one of the tray portions of the ladder platform.

FIG. 9 of the drawings shows an inverted perspective view of tray portion 11 of the ladder platform. Flanges 26 with apertures 28 are shown. The underside of base 16 is provided with strengthening webs 70 which extend across the portion 11 between flange 27 (which is of reduced height intermediate its ends) and face 51. Such a construction provides torsional rigidity to the platform and hence the ladder to which it is fitted. Such a degree of torsional rigidity is greater than that afforded by a conventional ladder top.

What I claim is:

1. A ladder platform for a ladder including a first tray portion, a second tray portion pivotally coupled to said first tray portion and movable from a storage position where said portion overly each other to a work position where the second tray portion forms an extension to the first tray portion to provide a tray.

2. The platform of claim 1 wherein said first tray portion has a substantially rectangular base with an upstanding peripheral wall, extending part way around the base.

3. The platform of claim 2 wherein the peripheral wall extends around three sides of said base.

4. The platform of claim 1 wherein said first portion has two spaced handles integral therewith and said handles are adjacent where stiles of the ladder would normally locate relative to the platform.

5. The platform of claim 4 wherein said handles are at opposed edges of said first tray portion.

6. The platform of claim 4 wherein the handles are contoured to provide hand grips for users and are directed towards the second tray portion.

7. The platform of claim 5 wherein the handles are contoured to provide hand grips for users and are directed towards the second tray portion.

8. The platform of claim 1 including attachment portions extending outwardly from said first tray portion for attaching the platform to stiles of a ladder.

9. The platform of claim 8 wherein said attachment portions consist of webs with apertures for fasteners.

10. The platform of claim 8 wherein said attachment portions form box sections for receiving ends of the stiles of a ladder.

11. The platform of claim 1 wherein said second portion is secured to said first portion by pivot pins.

12. The platform of claim 11 wherein said pivot pins are integral with said second portion.

13. The platform of claim 1 wherein said second tray portion has a substantially semi-circular base with a peripheral wall extending part way around the base.

14. The platform of claim 1 wherein the second portion, when in the storage position, nests within said first tray portion.

15. A ladder having a pair if stiles and a plurality of steps extending between the stiles at spaced locations therealong, a ladder platform mounted to free ends of the stiles, the platform having a first tray portion and a second tray portion pivotally coupled thereto, said second tray portion being movable from a storage position overlying the first portion to a work position where the second portion forms an extension to the first portion to provide a tray.

16. The ladder of claim 15 wherein said tray portions each have peripheral walls extending around the sides thereof such that the platform in the work position provides a recessed receptacle receiving zone.

17. The ladder of claim 15 wherein said portions have apertures for receiving and locating hand tools relative to the platform.

18. A step ladder having a front pair of spaced stiles, with a plurality of steps extending between them at spaced intervals therealong, a rear pair of spaced stiles with bracing members extending between them, a ladder platform mounted to free ends of the rear pair of stiles, said platform having a first tray portion secured to the free ends, a second tray portion pivotally coupled to said first tray portion, said second tray portion being movable from a storage position overlying the first tray portion to a work position extending away from said front pair of stiles and forming an extension to the first portion to provide a tray.

19. The ladder of claim 18 wherein said tray portions each have peripheral walls extending around the sides thereof such that the platform in work position provides a recessed receptacle receiving zone.

20. The ladder of claim 18 wherein said portions have apertures for receiving and locating hand tools relative to the platform.

* * * * *